US005997312A

United States Patent [19]

Ho et al.

[11] Patent Number: 5,997,312

[45] Date of Patent: Dec. 7, 1999

[54] GROUNDING CONTACT FOR HIGH SPEED, HIGH DENSITY CONNECTOR

[75] Inventors: Yu-Ming Ho, Pen-Chiao; Royce Huang, Pin-Jeng; Hsiang-Ping Chen, Taipei Hsien, all of Taiwan

[73] Assignee: Hon Hai Precision Ind. Co., Ltd., Taipei Hsien, Taiwan

[21] Appl. No.: 09/064,692

[22] Filed: Apr. 22, 1998

[30] Foreign Application Priority Data

Apr. 22, 1997 [TW] Taiwan ..... 86206471

[51] Int. Cl.[6] ..... H01R 9/09

[52] U.S. Cl. ..... 439/60; 439/637

[58] Field of Search ..... 439/637, 60, 108

[56] References Cited

U.S. PATENT DOCUMENTS 5,024,609 6/1991 Piorunneck ..... 439/60

5,496,180 3/1996 Fabian et al. ..... 439/60

*Primary Examiner*—Michael L. Gellner
*Assistant Examiner*—Antoine Ngandjui

[57] ABSTRACT

A grounding contact (1) for inducing noise on a pair of contacts (215) in a high speed, high density electrical connector (2) to ground includes a first section (10) and a second section (11) separated from each other. The first section (10) includes a contact portion (102) for engaging with a daughter board (40) inserted into the connector (2), a fitting portion (104) interferentially engaging with a housing (201) of the connector (2), and a terminal portion (12) to be fitted into a hole of a printed circuit board. The second section (11) includes a contact portion (112) for engaging with the daughter board (40), a fitting portion (114) interferentially engaging with the housing (201) of the connector (2), and a terminal portion (13) for engaging the terminal portion (12) and joining the two sections (10, 11) of the grounding contact (1) together.

16 Claims, 4 Drawing Sheets

GROUNDING CONTACT FOR HIGH SPEED, HIGH DENSITY CONNECTOR

BACKGROUND OF THE INVENTION

1. Field of The Invention

The present invention relates to a grounding contact for a high speed, high density connector, particularly to a grounding contact having contact portions which engage with contact traces on a mated daughter card without scraping the contact traces.

2. The Prior Art

Computers having a high processing speed and occupying a small space are the trend of computer technology development. To meet the trend, high speed and high density connectors are developed, but noise is the main problem affecting such connectors. Therefore, the connectors are equipped with grounding contacts, as disclosed in U.S. Pat. Nos. 5,026,292 and 5,051,099 and Taiwan Patent Application Nos. 79109775 and 80208341.

FIG. 1 of the present application appears as FIG. 3 in U.S. Pat. No. 5,026,292 ('292 patent) with different reference numbers. A grounding contact 3 is formed by stamping (blanking) a metal sheet to have a pair of cantilevered beams 30 each defining a contact portion 301 at a free end thereof. The contact portions 301 are connected to a common bight section 33. A terminal portion 32 extends downward from the bight section 33 to be soldered to a printed circuit board (not shown) for inducing noise received by the contact portions 301 to ground. A pair of projections 31 extend upward from the bight section 33 and engage with an internal wall of a housing of a connector (not shown) to hold the grounding contact 3 in position when the grounding contact 3 is mounted to the connector.

The grounding contact 3 of the '292 patent has been proven to successfully induce noise to ground; however, since the grounding contact 3 is made by blanking a metal sheet, the contact portions 301 thereof are formed with sharp edges which scrape and damage the contact traces on a daughter card when the daughter card is inserted into/withdrawn from the connector. Furthermore, the grounding contact 3 can only be mounted to the connector at a time, which is time consuming and laborious.

Hence, an improved grounding contact for a high speed, high density connector is needed to eliminate the above mentioned defects of current grounding contacts.

SUMMARY OF THE INVENTION

Accordingly, an objective of the present invention is to provide a grounding contact for a high speed, high density connector which engages with contact traces on a mated daughter card without scraping the contact traces.

Another objective of the present invention is to provide a grounding contact for a high speed, high density connector, wherein the grounding contact can be more efficiently assembled to the connector.

To fulfill the above mentioned objectives, according to one embodiment of the present invention, a grounding contact for inducing noise on a corresponding pair of contacts of a high speed, high density connector to ground includes a first and second section. The first section is formed with an elongate first and second body portion connected together via a generally U-shaped portion. The first body portion defines a first terminal portion for electrically connecting with a printed circuit board. The first terminal portion connects with the first body portion via a first horizontally bent portion. The second body portion defines a contact portion for engaging with a daughter card inserted into the connector. The second section is formed to have a configuration substantially the same as the first section, but with a shorter second terminal portion and a longer second horizontally bent portion. When the grounding contact is mounted to the connector, the second terminal portion engages with an upper part of the first terminal portion.

DETAILED DESCRIPTION OF THE PREFERRED EMBODIMENT

Reference will now be made in detail to the preferred embodiment of the present invention.

Figure 1:
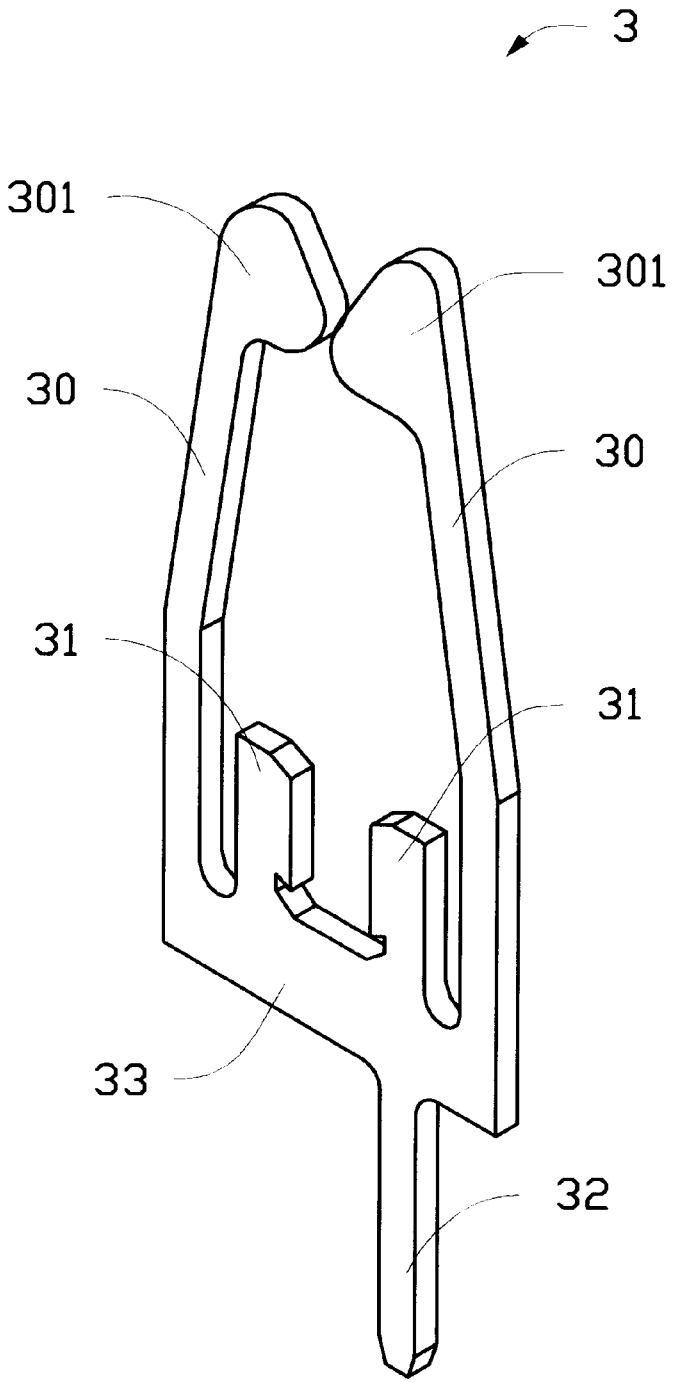
FIG.1 (PRIOR ART)
FIG. 1 is perspective view of a prior art grounding contact in accordance with U.S. Pat. No. 5,026,292.
Figure 2:
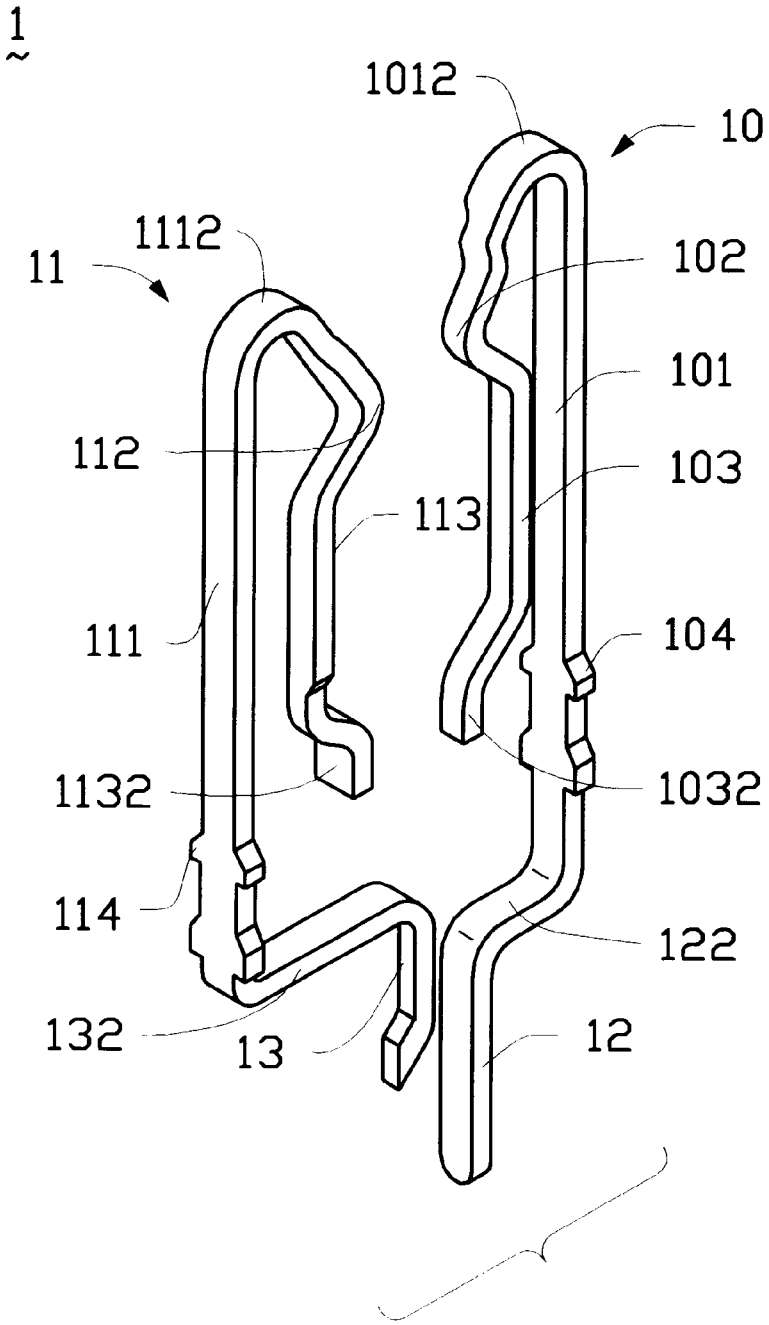
FIG. 2 is perspective view of a grounding contact in accordance with the present invention.

Referring to FIG. 2, a grounding contact 1 for engaging with a corresponding pair of contacts in a high speed, high density connector is shown. The contact 1 consists of a first section 10 and a second section 11. The first section 10 is formed by stamping and bending a metal sheet to have a first elongate body portion 101 and a second elongate body portion 103 parallel to the first body portion 101 and connecting therewith via a U-shaped portion 1012.

The first body portion 101 includes a fitting portion 104 consisting of four barbs, and a terminal portion 12 extending downward from the fitting portion 104 and connecting to a common blank portion (not shown). The terminal portion 12 connects with the first body portion 101 via a horizontally bent portion 122.

The second body portion 103 includes an upper arc-shaped contact portion 102 and a lower free engaging end 1032. The contact portion 102 and the free engaging end 1032 project from the second body portion 103 away from the first body portion 101.

Similar to the first contact section 10, the second section 11 is also formed with a first elongate body portion 111 and a second elongate body portion 113 parallel to the first body portion 111 and connecting therewith via a U-shaped portion 1112.

The first body portion 111 includes a fitting portion 114 consisting of four barbs, and a terminal portion 13 extending downward from the fitting portion 114 and connecting to a common blank portion (not shown). The terminal portion 13 connects with the first body portion 111 via a horizontally bent portion 132.

The second body portion 113 includes an upper arc-shaped contact portion 112 and a lower free engaging end 1132. The contact portion 112 and the free engaging end 1032 project from the second body portion 113 away from the first body portion 111. The terminal portion 13 of the second section 11 is shorter than the terminal portion 12 of the first section 10, while the horizontally bent portion 132 of the former is longer than the horizontally bent portion 122 of the latter.

Figure 3:
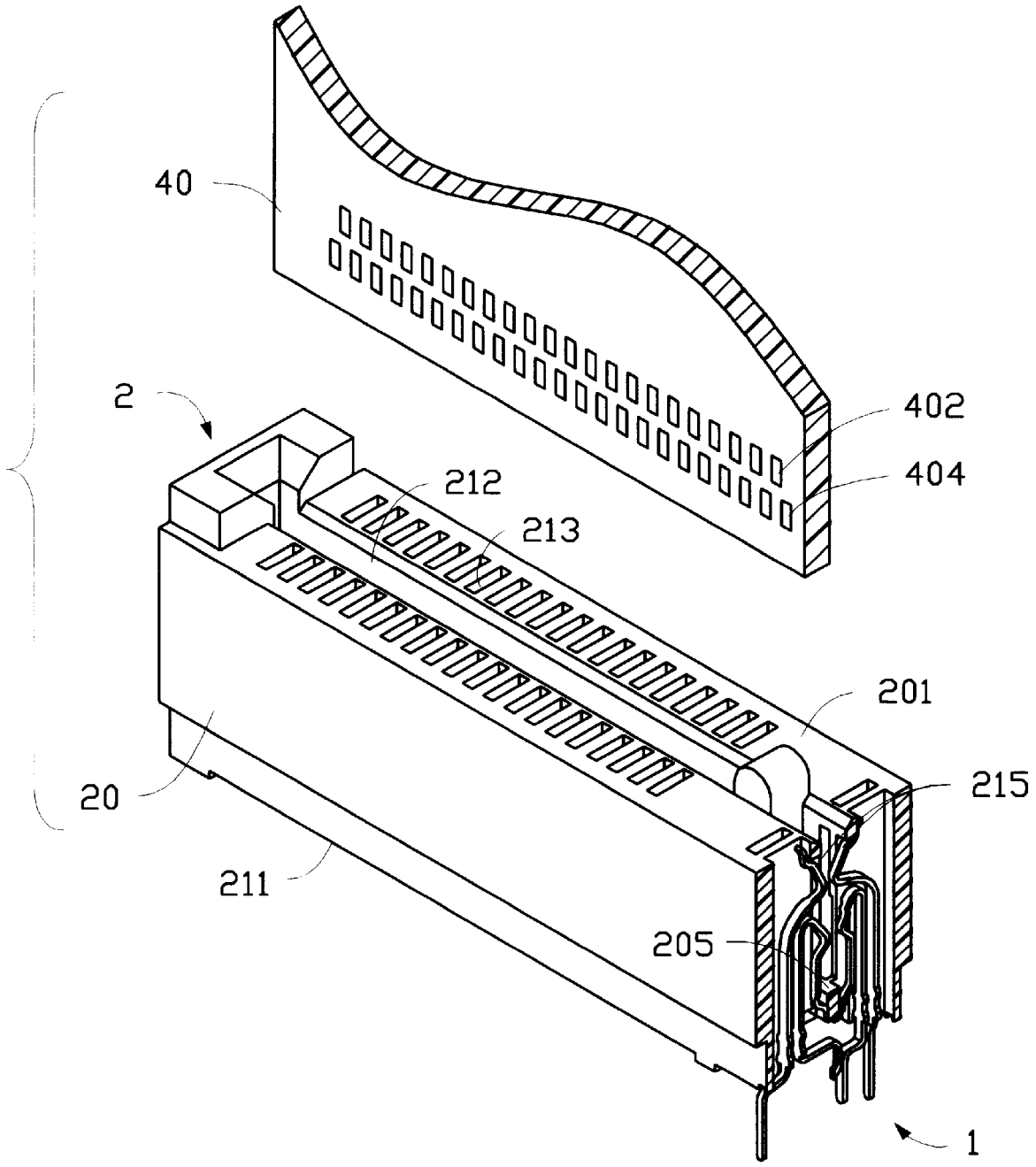
FIG. 3 is a partial cut-away, perspective view showing an electrical daughter board and a high speed, high density electrical connector incorporating the grounding contact of FIG. 2.

Referring to FIG. 3, a connector 2 incorporating the grounding contact 1 and a daughter card 40 to be inserted into the connector 2 are shown. The connector 2 has a dielectric housing 20 having a top mating face 201 defining a central slot 212 for receiving the daughter card 40, a bottom face 211 for mounting to a printed circuit board (not shown), a number of contact passageways 213 defined between the top and bottom faces 201, 211 and located beside the central slot 212 for receiving a number of contacts 215, and an internal wall 205 below the central slot 212. The daughter card 40 is provided with upper contact traces 402 for engaging with contact portions (not labeled) of the contacts and lower contact traces 404 for engaging with the contact portions 102, 112 of the grounding contacts 1 when the card 40 is inserted into the connector 2.

Figure 4:
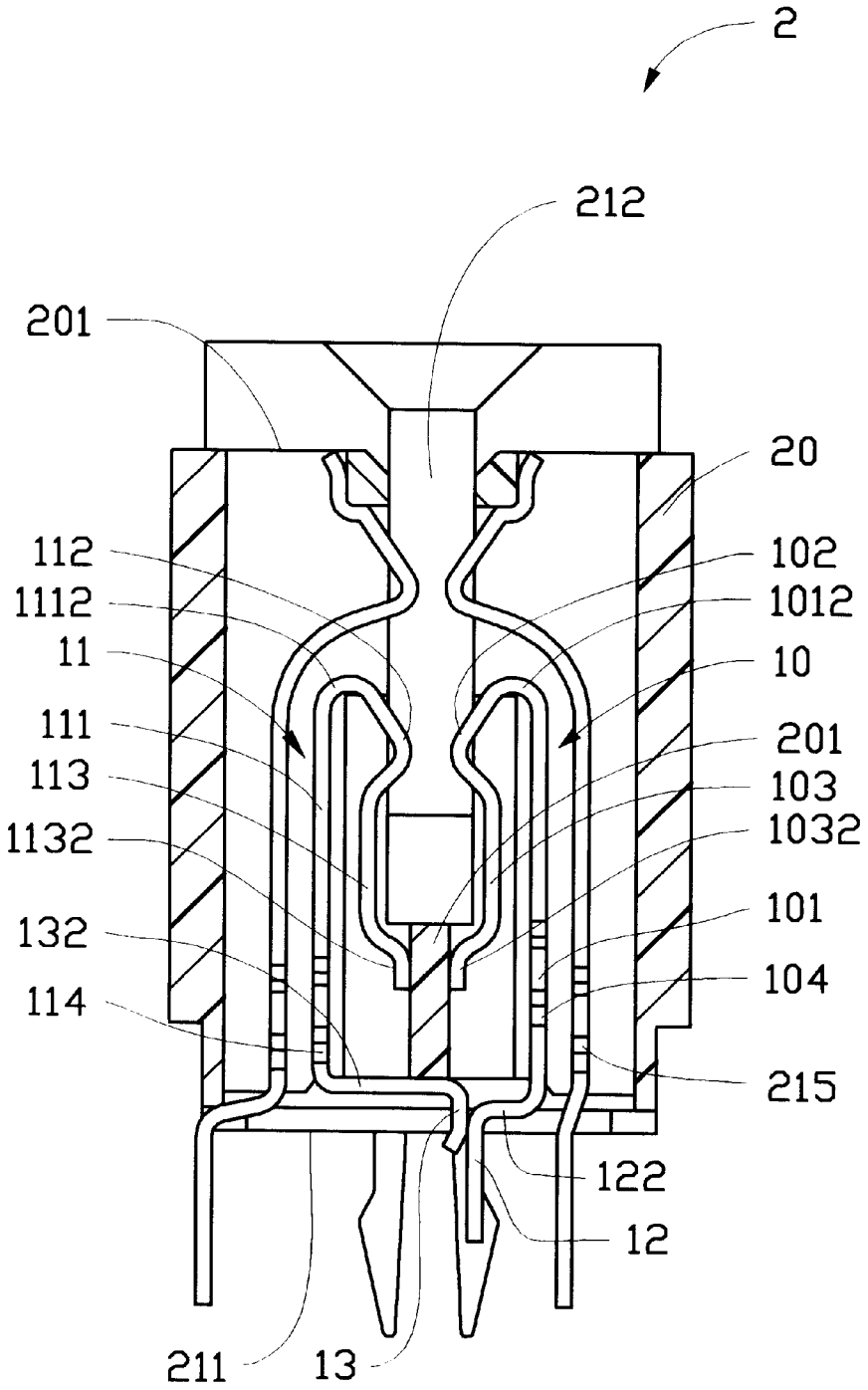
FIG. 4 is a right side view of the connector of FIG. 3.

Also referring to FIG. 4, to assemble the connector 2, the contacts 215 are mounted in the housing 20 by inserting the contacts 215 into the corresponding contact passageways 213 to cause fitting portions (not labeled) thereof to interferentially engage with the housing 20. Thereafter, the first sections 10 of the grounding contacts 1, which have their terminal portions 12 connected to the common blank portion (not shown), are mounted to the housing 20 on a right side of the central slot 212 to reach a position in which the fitting portions 104 interferentially engage with the housing 20 and the engaging ends 1032 are urged against the internal wall 205 thereby generating a preload in the contact portions 102 so that when the daughter card 40 is inserted into the slot 212, the contact portions 102 engage with the lower contact traces 404 of the daughter card 40. The blank portion (not shown) is then bent away from the terminal portions 12. Afterwards, the second section 11 is mounted to the housing 20 on a left side of the slot 212 by a manner similar to that for mounting the first section 10. However, when the first sections 10 are mounted, the terminal portions 12 thereof extend a sufficient distance beyond the bottom face 211 of the housing 20 so that the terminal portions 12 can extend through a printed circuit board (not shown) for being soldered thereto. When the second sections 11 are mounted, the terminal portions 13 thereof engage with an upper part of the terminal portions 12 of the corresponding first sections 10, whereby noise received by the second sections 11 can be induced to ground via the terminal portions 12 of the first sections 10. After the first and second sections 10, 11 are mounted, a soldering operation may be optionally applied to the contact point between the terminal portions 12, 13 to enhance the electrical connection therebetween.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. A grounding contact for inducing noise on a pair of opposite contacts in a high speed, high density connector to ground, comprising:

a first section comprising:

an elongate first body portion defining a first fitting portion for interferentially engaging with a housing of a connector, and a first terminal portion extending downward from the first fitting portion and connecting therewith via a first horizontally bent portion perpendicular to the first terminal portion and the first fitting portion; and an elongate second body portion parallel to the first body portion and connecting therewith via a first U-shaped portion, said second body portion defining an upper contact portion for electrically engaging with an inserted daughter card; and a second section separated from the first section, comprising:

an elongate third body portion defining a second fitting portion for interferentially engaging with the housing of the connector, and a second terminal portion extending, downward from the second fitting portion and connecting therewith via a second horizontally bent portion perpendicular to the second terminal portion and the second fitting portion; and an elongate fourth body portion parallel to the third body portion and connecting therewith via a second U-shaped portion, said fourth body portion defining an upper contact portion for electrically engaging with the inserted daughter card;

wherein the second terminal portion is shorter than the first terminal portion, the second horizontally bent portion is longer than the first horizontally bent portion, and the second terminal portion engages with the first terminal portion when the first and second sections of the grounding contact are mounted to the connector.

2. The grounding contact in accordance with claim 1, wherein each of the second and fourth body portions includes a free end projecting therefrom away from the first and third body portions, respectively.

3. An electrical connector, comprising:

a dielectric housing defining a central slot for receiving a daughter card and a number of pairs of contact passages beside the central slot;

a number of pairs of contacts each received in the corresponding pair of contact passages; and a number of grounding contacts each fixedly received in the housing and located below a corresponding pair of contacts, said grounding contacts each comprising:

a first section comprising:

an elongate first body portion defining a first fitting portion interferentially engaging with the housing of the connector, and a first terminal portion extending downward from the first fitting portion and connecting therewith via a first horizontally bent portion perpendicular to the first terminal portion and the first fitting portion; and an elongate second body portion parallel to the first body portion and connecting therewith via a first U-shaped portion, said second body portion defining an upper first contact portion for electrically engaging with an inserted daughter board; and a second section separated from the first section and comprising:

an elongate third body portion defining a second fitting portion interferentially engaging with the housing of the connector, and a second terminal portion extending downward from the second fitting portion and connecting therewith via a second horizontally bent portion perpendicular to the second terminal portion and the second fitting portion; and an elongate fourth body portion parallel to the third body portion and connecting therewith via a second U-shaped portion, said fourth body portion defining an upper second contact portion for electrically engaging with the inserted daughter board, wherein the second terminal portion is shorter than the first terminal portion and extends to engage with the first terminal portion.

4. The connector in accordance with claim 3, wherein the housing further forms an internal wall below the central slot, and wherein each of the second and fourth body portions further forms a free engaging end urged against the internal wall to generate a preload in each of the first and second contact portions.

5. The connector in accordance with claim 4, wherein the first contact portion and the free engaging end of the second body portion project from the second body portion away from the first body portion, and the second contact portion and the free engaging end of the fourth body portion project from the fourth body portion away from the third body portion.

6. The connector in accordance with claim 3, wherein the second terminal portion is soldered to the first terminal portion.

7. The connector in accordance with claim 3, wherein the second terminal portion engages with an upper part of the first terminal portion.

8. The connector in accordance with claim 7, wherein the second terminal portion is soldered to the upper part of the first terminal portion.

9. A method for forming an electrical connector, comprising the following steps:

preparing a dielectric housing to comprise a first face defining a central slot for receiving a daughter card therein, a second face opposite the first face and a number of pairs of contact passageways between the first and second faces and located beside the central slot;

preparing a number of pairs of contacts and fixedly mounting the contacts in the corresponding contact passageways;

preparing a number of grounding contacts each including a first section formed with a first terminal portion for electrically connecting with a printed circuit board and a second section formed with a second terminal portion;

fixedly mounting the first sections into the housing at a position where the first terminal portions extend beyond the second face of the housing; and fixedly mounting the second sections into the housing at a position where the second terminal portions engage with the first terminal portions of the corresponding first sections.

10. The method in accordance with claim 9, wherein each of the first sections are formed with a first elongate body portion and a second elongate body portion parallel to the first body portion and connecting therewith via at shaped portion, the first terminal portion being defined by the first body portion and the second body portion defining a first contact portion for engaging with an inserted daughter card.

11. The method in accordance with claim 10, wherein the housing is further formed with an internal wall below the central slot, and the second body portion defines a free engaging end below the first contact portion, said free engaging end being urged against the internal wall to generate a preload in the first contact portion.

12. The method in accordance with claim 11, wherein the first contact portion and the free engaging end project from the second body portion away from the first body portion.

13. The method in accordance with claim 9, wherein the first terminal portion is longer than the second terminal portion.

14. The method in accordance with claim 9 further comprising a step to solder the first and second terminal portions together after the step of fixedly mounting the second sections in the housing.

15. An electrical connector comprising:

a dielectric housing defining a central slot for receiving a daughter card and a number of pairs of contact passages beside the central slot;

a number of pairs of contacts each received within the corresponding pair of contact passages;

a number of grounding contacts positioned in the corresponding contact passages;

each of said grounding contacts including a first section and a second section separate from each other, said first section disposed in one of the corresponding pair of contact passages, while said second section disposed in the other of said corresponding pair of contact passages; wherein said first section includes a first terminal portion and said second section includes a second terminal portion, and said first terminal portion is engaged with said second terminal portion.

16. The connector in accordance with claim 15, wherein said second terminal portion is much shorter than the first terminal portion, and said first terminal extends a sufficient distance beyond a bottom face of the housing for projecting through a printed circuit board on which the connector is seated.

* * * * *